US005517952A

United States Patent [19]

Wielenga

[11] Patent Number: 5,517,952

[45] Date of Patent: May 21, 1996

[54] ROTATING SHUTTLE ENGINES WITH INTEGRAL VALVING

[76] Inventor: Thomas J. Wielenga, 49561 Donovan Blvd., Plymouth, Mich. 48170

[21] Appl. No.: 405,804

[22] Filed: Mar. 16, 1995

[51] Int. Cl.[6] ..... F02B 75/28

[52] U.S. Cl. ..... 123/45 R

[58] Field of Search ..... 123/45 R, 45 A

[56] References Cited

U.S. PATENT DOCUMENTS

| | | | |
|---|---|---|---|
| 1,613,136 | 1/1927 | Schieffelin | 123/45 A |
| 1,737,820 | 12/1929 | Ames | 123/45 R |
| 1,777,007 | 9/1930 | Mackenzie | 123/45 R |
| 2,473,936 | 6/1949 | Burrough | 123/45 R |
| 3,396,709 | 8/1968 | Robicheaux | 123/45 R |
| 4,136,647 | 1/1979 | Stoler | 123/45 R |
| 4,553,506 | 11/1985 | Bekiaroglou | 123/45 R |
| 5,161,491 | 11/1992 | Graves | 123/45 A |

FOREIGN PATENT DOCUMENTS

| | | | |
|---|---|---|---|
| 819936 | 11/1951 | Germany | 123/45 A |
| 2134584 | 1/1973 | Germany | 123/45 A |
| 3831451 | 4/1990 | Germany | 123/45 R |

*Primary Examiner*—Michael Koczo

*Attorney, Agent, or Firm*—Howard & Howard

[57] ABSTRACT

The present invention relates to an internal combustion engine and, in particular, to an improved internal combustion engine having shuttles whose combined rotational and reciprocating motion produce output power and, at the same time, provide valving for the engine. In the preferred embodiment, there are two shuttles which move in opposed directions to balance the engine. The shuttles have a sinusoidal cam mounted about their periphery which is restrained so that the shuttle reciprocates and rotates within the cylinder. Each shuttle has opposed faces with recesses that mate with projections from the cylinder head to define combustion chambers. Ports are formed in the cylinder walls which communicate with ports in the shuttle sleeves to provide intake and exhaust to the combustion chambers.

18 Claims, 3 Drawing Sheets

ROTATING SHUTTLE ENGINES WITH INTEGRAL VALVING

BACKGROUND OF THE INVENTION

The present invention relates to an internal combustion engine and, in particular, to an improved internal combustion engine having shuttles whose combined rotational and reciprocating motion produce output power and, at the same time, provide valving for the engine.

There are numerous types of internal combustion engines. Most internal combustion engines have a reciprocating piston wherein the piston slides back and forth in a cylinder and transmits power through, for example, a connecting rod and crank to a drive shaft. This arrangement is called a slider-crank mechanism. These engines are typically two-stroke or four-stroke engines and include valve ports and valves for controlling the intake of fuel and the exhaust of combustion products. The intake and exhaust valves are normally controlled by a rocker arm attached to a push rod that is controlled by a camshaft. The pistons are normally connected to a crankshaft by a connecting rod which allows the piston to reciprocate within the cylinder.

Although the above-described internal combustion engines are widely used, there are disadvantages to using them, such as the number of parts employed and the cost of manufacturing these various parts. Another problem is the need to time the camshaft and crankshaft so that they operate in the correct sequences. Still a further problem is in the balancing of these engines to limit the vibrations which occur in the operation of the engine. An additional problem is variations in output torque on the drive shaft due to reciprocating masses. These variations in output torque are called inertia torques.

Another type of engine is the sleeve valve engine. It is a conventional slider-crank mechanism type of engine with a variation in valving. As described in *The Motor Vehicle,* K. Norton, W. Steeds, T. K. Garrett (1989), the sleeve valve engine employs a sleeve interposed between the cylinder wall and the piston. The sleeve is in continuous motion and admits and exhausts the gases by virtue of the periodic coincidence of ports cut in the sleeve with ports formed through the main cylinder casting and communicating with the induction and exhaust systems.

As further described in the above publication, the Butt McCullum single sleeve valve has both rotational and axial movement. In the disclosure, the sleeve obtains its rotational and axial movement through a ball and socket joint operated by short transverse shafts. The ball is mounted on a small crank pin integral with a cross-shaft, which is driven at half-engine speed through skew gears from a longitudinal shaft.

The sleeve valve engine has advantages over the above-described reciprocating piston engine. One advantage is that the sleeve valve eliminates the need for poppet valves. Further, it is relatively quiet in operation. A major disadvantage is serious mechanical trouble in the event of piston seizure, which dangerously overloads the sleeve driving gear. A further disadvantage is the cost of the sleeve drive gearing.

Along with the slider-crank type of engines, there are unconventional configurations which have not met with long-term success. One class of these configurations is the Barrel or Revolver engines as discussed in *The Internal Combustion Engine in Theory and Practice,* Volume 2, "Combustion, Fuels, Material, Design," Charles Fayette Taylor (MIT press 1985). These engines have their cylinders arranged parallel to and generally around the output shaft. In addition, they employ a cam or wobble plate to convert the reciprocating motion of the pistons to rotational motion of the output shaft. The disadvantage to these engines is the reliability of the cam to piston interface. The bearings at the cam to piston interface are in motion, and beefing up the bearings adds mass and creates larger inertia forces which must, in turn, be carried by still larger bearings. Forces are very high at large piston speeds, which makes the engine unreliable. Another disadvantage to these engines is that their arrangement of cylinders makes it difficult to service.

Another class of engines described in the above publication, are the rotary displacement engines. In these engines, a rotating member varies the working volume of the combustion chamber in a way similar to vane-type compressors. The most famous of this type of engine is the Wankel engine. These engines have low vibration. The disadvantage to these engines is that they invariably have combustion chamber sealing problems.

Another class of engines described in the above publication, are those involving cams, levers, or Scotch Yokes, introduced between the piston and the output shaft. These again have large bearings moving in reciprocation. The Fairchild Caminez radial engine came close to success but because of large output shaft torques due to the reciprocating masses (inertia torques) it did not achieve success.

SUMMARY OF THE INVENTION

The present invention overcomes the above disadvantages found in conventional internal combustion engines, sleeve valve engines, and the unconventional engines described above. Broadly, the rotating shuttle engine of the present invention provides an internal combustion engine that is easy to manufacture, having only three moving parts; i.e. an output shaft and two shuttles. Further, the cylinders in which the shuttles move are identical and require only one mold for their manufacture. The rotating shuttle engine has no poppet valves and no extra gearing to move a sleeve valve. There are no reciprocating bearings, no sealing problems, and the external inertia forces, moments and output shaft inertia torques can be completely eliminated in various configurations of the basic design.

The rotating shuttle engine can be arranged so that the shuttles reciprocate with opposing motions. The result is that it does not generate external vibrations. This is an advantage in that specially designed mounts or balancing shafts are not needed. This makes it possible for larger engines to be used in hand-held applications. It also reduces the noise and vibration from the engine, which is especially important in vehicles, such as luxury cars and small airplanes.

Because of the lack of popper valves, there is no clatter of valves opening and closing and none of the problems associated with the dynamics of valve trains at high speeds. Additionally, since the intake charge is received through the same sleeve port that the hot exhaust is expelled, this area is automatically cooled. Thus, there are no hot spots in the engine to induce pre-ignition, which allows lower octane fuel or alternative fuels to be used. Also, since the ignition device can be situated in the side wall and only exposed to the combustion chamber when the sleeve port passes over it, some applications may use a glow plug instead of a spark plug to ignite the mixture.

In the preferred embodiment of the invention, during one rotation of the engine, four equally-spaced power strokes are accomplished. There are four combustion chambers, and each one goes through all four cycles in one engine rotation, which smooths out the output torque of the engine.

In further embodiments of the invention, more shuttles and cylinder pairs can be added end to end to create more powerful versions of the engine. With three shuttles, inertia torques can be completely eliminated, and during one shuttle rotation six power strokes would be accomplished. These more powerful versions would not require redesign of component parts except the output shaft and oil pan.

Another way to add power and eliminate inertia torques is to add a second bank of shuttles working out of phase by 45 degrees on the same output shaft. This four shuttle engine would have no inertia torques and eight equally spaced power strokes. Additional versions of the engine could have single shuttles arranged around the output shaft. In these versions, however, balancing shafts may be needed to completely balance the engine.

Additional versions of the engine could have single shuttles arranged around the output shaft. In these versions, however, balancing shafts may be needed to completely balance the engine.

Another advantage of the present invention is that the output shaft is parallel to the axis of travel of the pistons. This reduces the overall size of the engine. A further advantage is that the intake ports can be aligned, and the exhaust ports can be aligned, reducing space requirements for the engine.

A still further advantage of the present rotating shuttle engine is in the ease of lubrication. Lubrication can be very simple and does not require an oil pump. Lubrication can be obtained by oil spray through the normal movement of the parts.

Another advantage of the rotating shuttle engine is that there are two pairs of bearings per shuttle fixed in the cylinder walls. This division of bearings allows the forces born by each bearing pair to be halved. In addition, since these bearings are fixed and do not move, they do not add to the inertia forces produced by the shuttle. Also since the pairs of bearings are situated on opposite sides of the cylinder, the forces applied to the shuttle are symmetric and keep the shuttle aligned with the axis of the cylinders. This reduces wear on the cylinder walls and the shuttle which in turn allows close sleeve valve sealing.

Another advantage the rotating shuttle engine has over rotary displacement engines is the assurance of tight sealing of the combustion chamber. Piston rings can be employed to seal the combustion chambers as in conventional engines.

The present invention is an internal combustion engine whose preferred embodiment includes two shuttles. Each shuttle reciprocates and rotates during the operation of the engine. Each shuttle has two ends, each of which has a cylindrical cavity. The cavities on the ends are not connected to each other. The walls formed by the inner cylindrical cavity and the outer cylindrical wall of the shuttle is a sleeve. Through each of these sleeves is a sleeve port which communicates the inner cavity of the shuttle to the outside of the sleeve. As the shuttle rotates and reciprocates the sleeve ports move into communication with ports in the cylinder walls for admitting the intake gases and for exhausting the combustion gases.

The cylinder walls are closed at the end by a cap containing a cylindrical protrusion which closely fits within the shuttle's cylindrical cavity. This protrusion is shaped like a piston and may contain piston rings. In the rotating shuttle engine, the pistons do not move—the shuttles do. The chamber formed by one of the shuttle's cavities and one of the cylinder's pistons is a combustion chamber.

Around the shuttle's mid section is a cylindrical cam. The cam surface on the shuttle is in contact with guide means (normally rollers) on the cylinder which tie rotation of the shuttle to reciprocation of the shuttle. When the shuttle rotates it must also reciprocate (and vice-versa).

On the outer surface of the cam are gear teeth. These gear teeth must always pass between each of the bearing pairs fixed in the cylinder wall. Below one of these bearing pairs the gear teeth of the cam mesh with gear on the output shaft. When the shuttle rotates within the cylinder, the output shaft must also rotate.

It should be appreciated that the mechanical arrangement of rotating shuttle and integral valving of the chamber is also useful for compressing gases and pumping fluids. It is also useful for the opposite tasks of expanding gasses for useful work and for harnessing the flow of fluids for useful work.

DETAILED DESCRIPTION OF THE INVENTION

Figure 1:
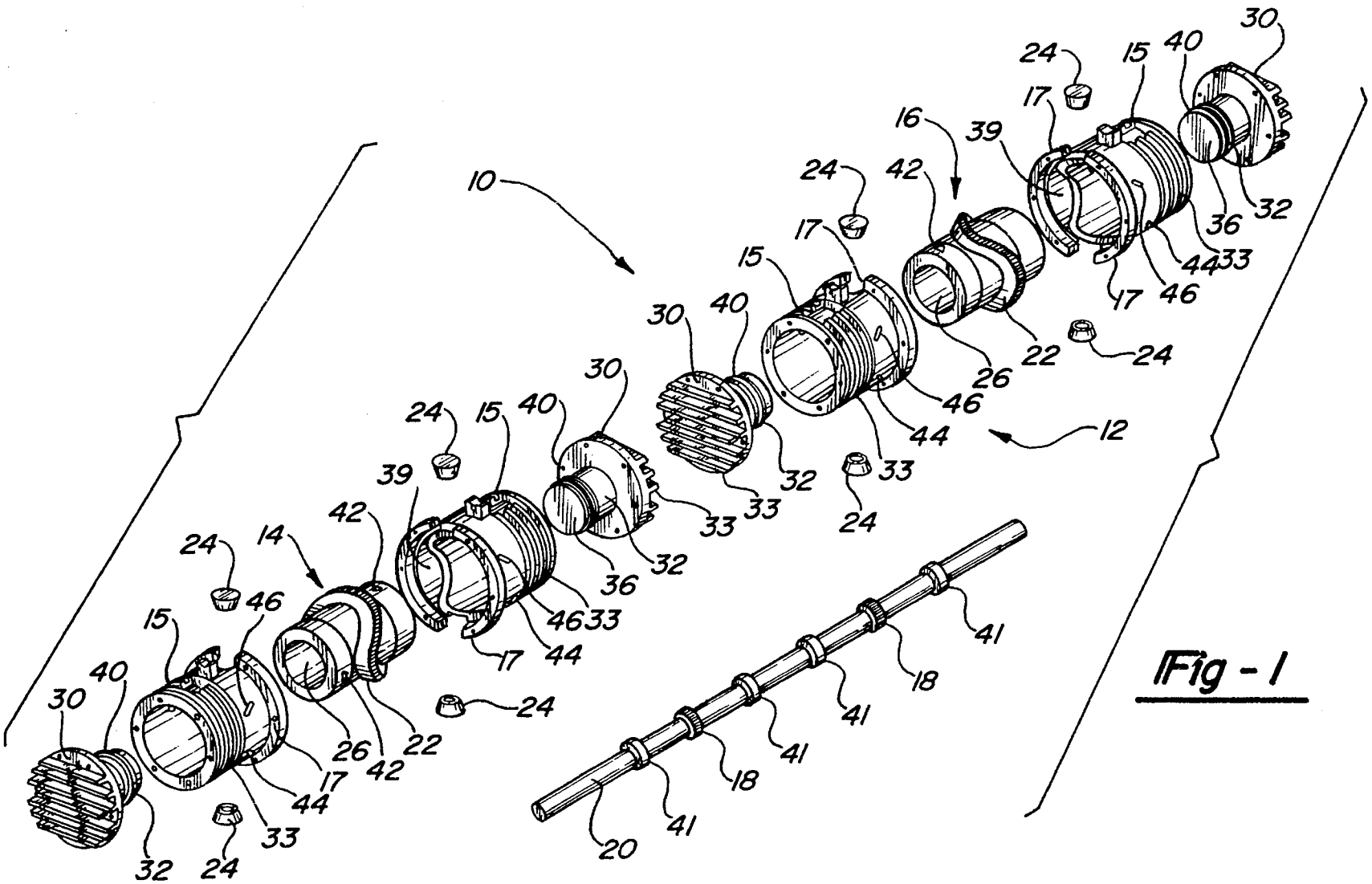
FIG. 1 is an exploded view of the rotating shuttle engine of the present invention.

With reference to FIG. 1, the axial engine of the present invention is shown generally at 10. Broadly, the engine 10 includes a cylinder housing 12 in which a pair of shuttles 14 and 16 reciprocate and rotate. The shuttles 14 and 16 are operatively connected through cams 22 to gears 18 which are mounted upon output shaft 20. As the shuttles 14 and 16 reciprocate, their linear motion is converted to rotational motion by the cams 22 and is transferred to shaft 20 as the power output of the rotating shuttle engine 10.

Figure 2:
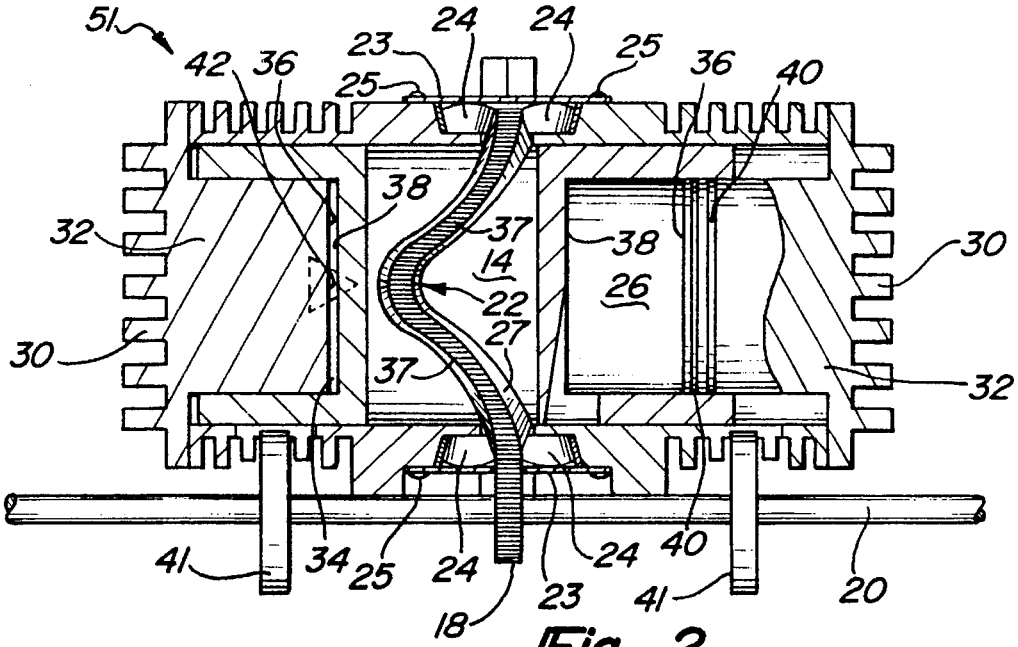
FIG. 2 is a partial cut-away view of a shuttle and the enclosing cylinder pair of the present invention.

The cylinder housing 12 is formed of four cylinder sections 15. Each is identical and can be cast in the same mold to reduce manufacturing costs. The cylinder sections 15 are preferably made of aluminum and are bolted through holes 17 to form a cylinder pair 51 which enclose a shuttle (see FIG. 2). The cylinders are capped by piston heads 30. Cylinder pairs 51 are joined end to end to form the cylinder housing. The disclosed embodiment shows the inner piston heads joined together, but the inner piston heads could be made in one piece and bolted to both adjoining cylinder sections. As can be seen in FIG. 1, the cylinder has cooling fins 33 along its exterior to aid in cooling. The disclosed embodiment is air cooled; however, the engine could be cooled by water or other cooling means.

The shuttles 14 and 16 are identical. For ease of understanding, only one of the shuttles and one of the cylinder pairs 51 will be described in detail. With regard to FIG. 2, a cut-away section of shuttle 14 and its enclosing cylinder pair is illustrated. Shuttle 14 is cylindrical and has a pair of cylindrical cavities 26 extending into both faces of the shuttle 14. Each cavity 26 has an inside diameter that is slightly greater than the piston heads 32 which are cylindrical projections extending from the head of the cylinder. Each piston head 32 is closely received within the shuttle cavity 26 to form opposed combustion chambers 34 within the shuttle 14. Each combustion chamber 34 is defined by the space between the respective face 36 of piston head 32 and the base 38 of the respective shuttle cavity 26. The space is formed because the reciprocal motion of the shuttle 14 is less than the length of piston head 32. In the preferred embodiment, sealing rings 40 are mounted about the perimeter of the piston head 32 to form a seal between piston head 32 and the interior wall of the shuttle cavity 26 to maintain the combustion gases and fuel air mixture within the combustion chamber 34.

Shuttle ports 42 are formed in the sidewall of shuttle 14 to communicate the opposed combustion chambers 34 with an inlet port 44 and outlet or exhaust port 46 in cylinder section 15. See FIG. 1. As illustrated, the ports 44 and 46 are elongated and angled with respect to a radially extending arc generated from the center of the cylinder. In fact, the ports 44 and 46 are on a spiral path corresponding to the path of shuttle port 42 as the shuttle 14 both translates and rotates. As the shuttle 14 reciprocates and rotates within the cylinder section 15, shuttle port 42 alternately communicates with inlet port 44 and exhaust port 46. As the shuttle port 42 communicates with the inlet port 44, an air and fuel mixture is drawn into the combustion chamber 34. As the shuttle continues to move within cylinder section 15, the shuttle port 42 rotates away from the inlet port 42 and is closed by the inner wall of cylinder section 15. With the shuttle port closed, the fuel air mixture can be compressed and then ignited. After further rotation and translation, the shuttle port 42 intersects the exhaust port 46 and the gases are exhausted. In this way, there is no need for intake and exhaust valves to open and close the combustion chamber.

With reference again to FIGS. 1 and 2, the exterior of the shuttle 14 has a cam 22 mounted upon its periphery. In the preferred embodiment, the cam 22 and, consequently, the shuttle 14 are restrained longitudinally within rollers 24 so that the translational movement of the shuttle 14 is converted to rotational movement. In this embodiment, the shuttle 14 has a generally sinusoidal translation. The rollers are mounted within the cylinder pair by a cap 23 which is bolted by bolts or screws 25 to a cylinder pair. Preferably the rollers are mounted on an axis in cap 23 which is not shown. Additionally, the rollers may be in the shape of a truncated cone which conforms to the shape of the sidewalls 27 of the cam 22. The cam sidewalls 27 may be sloped. This mating shape of the cam sidewalls and rollers reduces wear of the rollers 24 and the cam 22. Additionally, the cam 22 has a changing thickness. At the region 37 between the peaks in the cam 22, the cam is slightly narrower. This facilitates movement of the cam with respect to the rollers 24 and strengthens the cam at the peaks.

Figure 3:
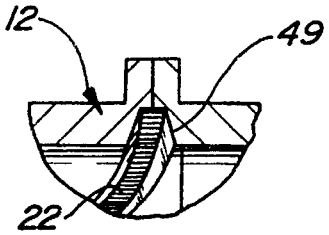
FIG. 3 is a partial view of a further embodiment of the present invention.

With reference to FIG. 3, a further embodiment of the present invention is illustrated. In this embodiment, the rollers 24 are not used. The cam 22 rides within a grove 49 formed in the inner wall of cylinder pair 51 where the rollers 24 would have been.

The cam has teeth formed on its exterior surface which mate with gear teeth on gear 18 on output shaft 20. As will be appreciated, the gear 18 will always be turned in the same direction. The cam 22 shifts the back and forth translational movement of the shuttle to a constant direction rotation of gear 18. The cam 22 translates the reciprocating movement of shuttle 14 to rotational movement along an axis parallel to the travel of piston 14.

In the disclosed embodiment, lubrication is supplied to the pistons 14 and 16 by disks 41. Disks 41 are received within openings in cylinder 12 and ride in an oil bath, which is not shown. As should be appreciated, as the output shaft 20 rotates, oil is sprayed onto pistons 14 and 16 by disks 41. Oil is supplied to the rollers, cam and shuttle by the spray generated by rotation of the gear 18 within the oil bath.

The interior wall of the cylinder 12 has a recess 39 formed in it that is wide enough to permit the cam 22 to rotate within it. As should be appreciated, the widest part of the recess 39 is slightly greater than the distance between the peaks of the sine wave measured along the Y-axis. The narrowest part of recess 39 is at rollers 24, and its widest portion is slightly larger than the width of cam 22.

With reference to FIGS. 5–8, the operation of the rotating shuttle engine will be described. In operation, the shuttles are moving with opposed motions. They are either both traveling toward each other or away from each other. In this way, vibration within the engine is canceled. For purposes of the following discussion we will label the four combustion chambers A, B, C, D as noted in FIGS. 5–8. The shuttle ports associated with these chambers we will also label A, B, C, D to distinguish them.

Figure 5:
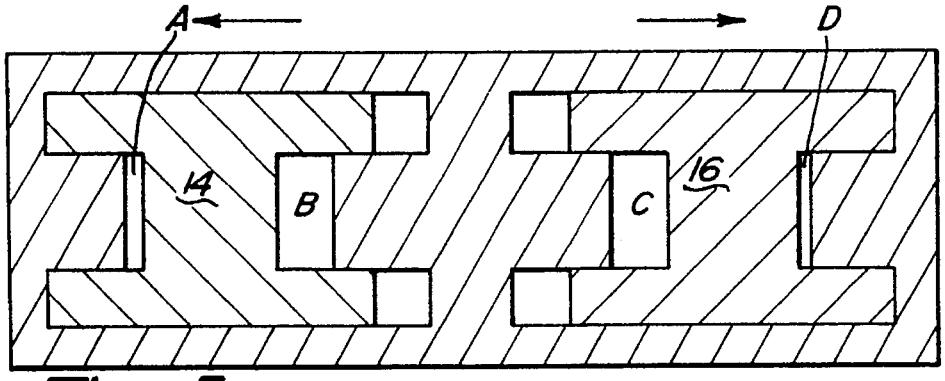
FIGS. 5–8 are cutaway views of the rotating shuttle engine illustrating the engine cycle.

Referring to FIG. 5, the first cycle of the rotating shuttle engine is illustrated. Shuttle 14 and 16 are moving outward. Shuttle 14 has the A combustion chamber shuttle port closed by the cylinder wall and the air and fuel mixture is being compressed within combustion chamber A. At the opposite end of shuttle 14, the B chamber shuttle port is also closed by the cylinder wall and the gases are being expanded in a power stroke. Meanwhile the C chamber on shuttle 16 is drawing in fresh air and fuel mixture in an intake stroke. The C chamber shuttle port is communicating with the intake port. The D chamber is exhausting combustion products through D shuttle port into the exhaust port.

In summary, for FIG. 5, the four chambers are near the end of the following strokes:

A—compression

B—power

C—intake

D—exhaust

As the motion continues, the shuttles reach the extent of their outward motion. In chamber A, the shuttle port reveals the ignition device in the cylinder wall and the compressed gases are ignited.

As motion continues the shuttles begin to travel toward each other. In chamber A, the shuttle port continues to be closed by the cylinder wall and the combustion gases are expanded in a power stroke. In chamber B, the shuttle port communicates with the exhaust port and the exhaust gases are expelled. In chamber C, the shuttle port is now closed by the wall and the fresh intake charge is compressed. In chamber D, the shuttle port moves into communication with the intake port and no longer communicates with the exhaust port. Chamber D begins drawing in a fresh intake charge. During this cycle and during each cycle the shuttles rotate through a quarter turn.

Figure 6:
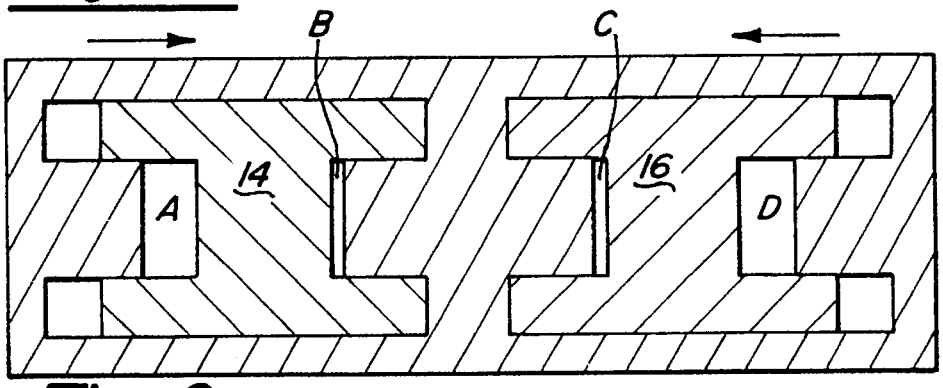

As illustrated in FIG. 6, the four chambers are near the end of the following strokes.

A—power

B—exhaust

C—compression

D—intake

As the motion continues, the shuttles reach the extent of their inward motion. In chamber C, the shuttle port reveals the ignition device in the cylinder wall and the compressed gases are ignited.

As motion continues, the shuttles begin to travel away from each other. In chamber A, the shuttle port moves into communication with the exhaust port. In chamber B, the shuttle port moves into communication with the intake port and no longer communicates with the exhaust port. In chamber C, the shuttle port continues to be closed by the cylinder wall and the combustion gases are expanded in a power stroke. In chamber D, the shuttle port is now closed by the wall and the fresh intake charge is compressed.

Figure 7:
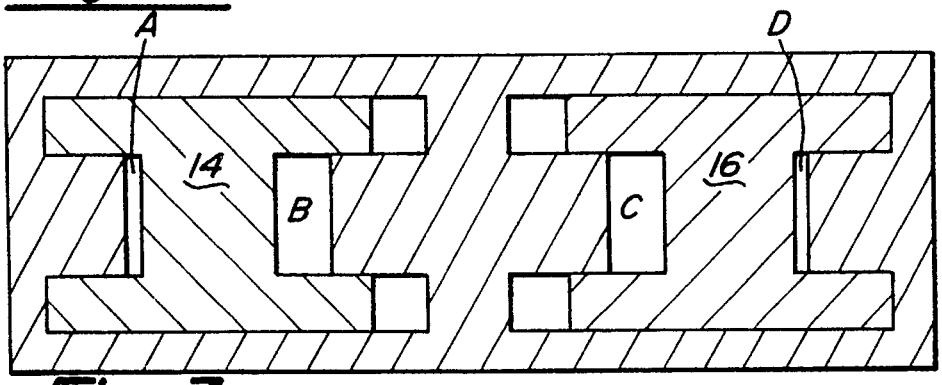

As illustrated in FIG. 7, the four chambers are near the end of the following strokes.

A—exhaust

B—intake

C—power

D—compression

As the motion continues, the shuttles reach the extent of their outward motion. In chamber D, the shuttle port reveals the ignition device in the cylinder wall and the compressed gases are ignited.

As motion continues, the shuttles begin to travel toward each other. In chamber A, the shuttle port moves into communication with the intake port and no longer communicates with the exhaust port. In chamber B, the shuttle port is now closed by the wall and the fresh intake charge is compressed. In chamber C, the shuttle port moves into communication with the exhaust port. In chamber D, the shuttle port continues to be closed by the cylinder wall and the combustion gases are expanded in a power stroke.

Figure 8:
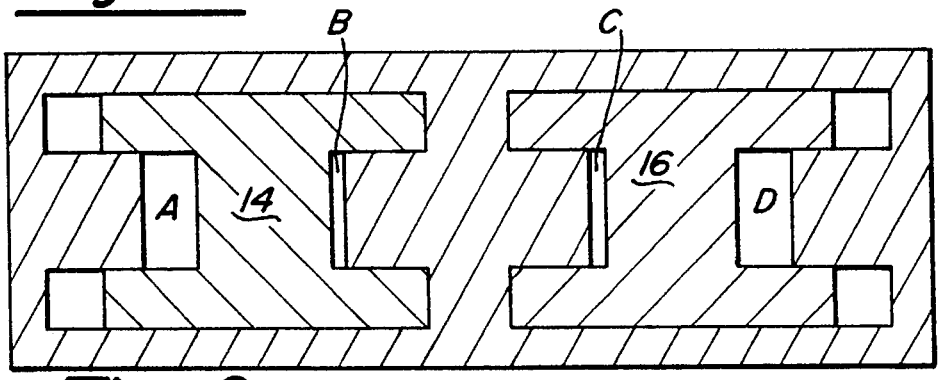

As illustrated in FIG. 8, the four chambers are near the end of the following strokes.

A—intake

B—compression

C—exhaust

D—power

The engine has now completed all for strokes for each chamber and begins the cycle again. The shuttles have rotated through one complete turn. In summary, the chambers proceed through the following strokes:

| | ¼ | ¾ | ¾ | ⁴⁄₄ |
|---|---|---|---|---|
| A | compression | power | exhaust | intake |
| B | power | exhaust | intake | compression |
| C | intake | compression | power | exhaust |
| D | exhaust | intake | compression | power |

As should be apparent, the rotating shuttle engine has four chambers working in a four stroke cycle, allowing one power stroke per quarter turn.

As should be understood, the shuttles are coupled to each other through the output shaft 20, and the shuttles 14 and 16 drive one another when not in a power stroke.

Figure 9:
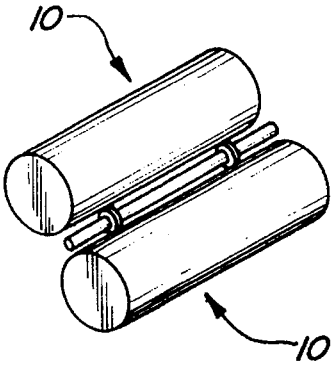
FIG. 9 is an illustration of a further embodiment of the present invention.
Figure 4:
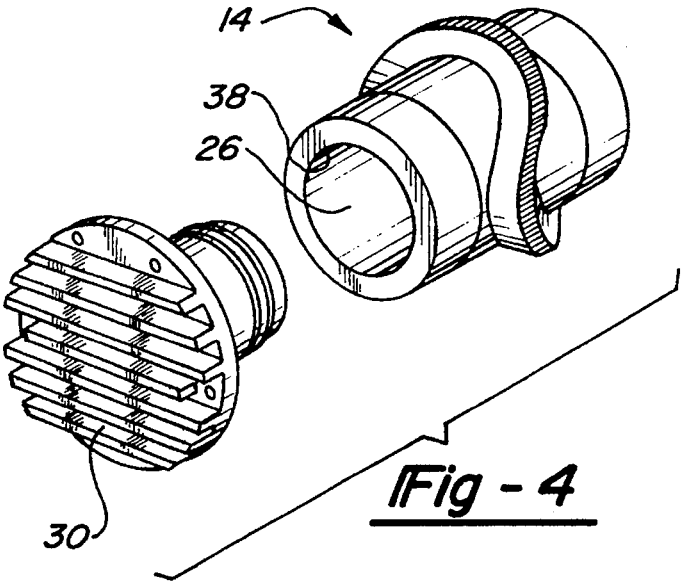
FIG. 4 is a perspective view of a shuttle and piston.

With reference to FIG. 9, a further embodiment of the present invention is illustrated. In this embodiment, a pair of rotating shuttle engines 10 are interconnected to an output shaft 20. Each engine 10 is 45 degrees out of phase with respect to the other. By arranging the engines in this way, the inertia torques on the output shaft are completely balanced and the output torque of shaft 20 is as smooth as possible.

As should be appreciated by one of ordinary skill in the art, the above is a description of an exemplary embodiment of the present invention which should not be limited other than as described in the following claims.

What is claimed is:

1. An internal combustion engine comprising:

at least two in-line cylinder pairs having cylinder heads;

at least two shuttles, each of which is mounted within a respective one of said combustion cylinders, said shuttles being mounted for rotational and reciprocal movement within said respective cylinder pairs, said shuttles having opposed faces, each of said faces having a recess therein, and each of said cylinder heads having a projection adapted to mate with said recesses to define opposed combustion chambers within each of said shuttles, said shuttles further including ports in communication with said combustion chambers, said ports extending through the side wall of said shuttles adjacent said recesses; and an output shaft operatively connected to said shuttles, said output shaft being generally parallel to the travel path of said reciprocating shuttle: said output shaft being mounted external to said cylinder pairs and said shuttles;

whereby said internal combustion engine has cylinders with only one internal moveable part.

2. The internal combustion engine of claim 1, wherein each of said shuttles is defined by a body and opposed faces generally perpendicular to said body, said shuttles further including a sinusoidal-shaped cam extending about the periphery of said body and guide means engaging said cam; and said cam has a face and sides, said sides engaging said guide means whereby said piston reciprocates and rotates in response to the interaction of said cam and said guide means.

3. The internal combustion engine of claim 2, wherein said cam face includes gear teeth for meshing with an output shaft.

4. The internal combustion engine of claim 1, wherein each of said ports are generally triangular-shaped, with the apex of said triangular shape being adjacent said combustion chamber.

5. The internal combustion engine of claim 1, wherein each of said shuttles reciprocate with opposed motions.

6. An internal combustion engine comprising:

at least one cylindrical shuttle and two cylindrical chambers;

said cylindrical chambers being joined at one end and having their free ends closed by cylindrical heads, said cylindrical heads including protrusions which protrude into said chambers;

said shuttle being mounted for rotational and reciprocal movement within said chambers, and having opposed combustion cavities which mate with said protrusions to form gas-tight combustion chambers;

said shuttle having ports for communication with intake and exhaust ports in said chamber for communication with said combustion chamber; and an externally mounted output shaft operatively connected to said shuttle;

whereby said internal combustion engine has only said shuttle as a moving part internally to said chambers.

7. The internal combustion engine of claim 6, wherein said shuttle has a sinusoidal-shaped cylindrical cam around the periphery of the said shuttle body; and said chamber includes bearing pairs between which said cam is guided;

whereby said shuttle moves rotationally and reciprocally within said chamber.

8. The internal combustion engine of claim 7, wherein the output shaft is operatively connected to the shuttle through gear teeth formed on the shuttle and the output shaft.

9. The internal combustion engine of claim 6, wherein two or more shuttles and chamber heads are mounted along an axis, whereby the mechanism is balanced during operation.

10. The internal combustion engine of claim 6, wherein two or more shuttles and cylinder pairs are arranged around the output shaft.

11. The internal combustion engine of claim 9, wherein the chambers are used for the intake, compression, and combustion of fuel and air and the exhaust of combustion products.

12. The internal combustion engine of claim 11, wherein the said engine is a four-cycle engine.

13. The internal combustion engine claim 11, wherein the said engine is a two-cycle engine.

14. The internal combustion engine of claim 6, further including two sleeve ports per chamber, giving a set of two two-stroke cycles per shuttle rotation.

15. An internal combustion engine comprising:

adjacent in-line cylinder pairs; said cylinder pairs having a generally tubular portion with opposed cylinder heads defining an internal chamber, each of said cylinder heads including a projection, projecting into said internal chamber;

a shuttle mounted in said internal chamber of each cylinder pair, said shuttle being mounted for rotational and reciprocal movement within said cylinder pair, said shuttle having a body portion and opposed end faces, each of said end faces having a recess defining a cavity, each of said cavities being configured to receive a respective one of said projections in a gas-tight manner to define a plurality of combustion chambers;

said shuttle including a sinusoidal-shaped cylindrical cam around the outer periphery of said shuttle body; said chamber including guides for guiding said cam; said cam further including gear teeth, said gear teeth being partially exposed through said cylinder pairs;

an output shaft mounted externally to said cylinder pairs, said output shaft operatively engaging said exposed gear teeth;

whereby cylinder pairs of said internal combustion engine have only a single internal moveable part.

16. The internal combustion engine of claim 15, wherein said shuttles include ports in communication with said combustion chamber, said ports extending through the side wall of said shuttles adjacent said recesses.

17. The internal combustion engine of claim 16, wherein each of said ports are generally triangular-shaped with the apex of said triangular-shape being adjacent said combustion chamber.

18. The internal combustion engine of claim 15, wherein said chamber includes bearing pairs between which said cam is guided;

whereby said shuttle moves rotationally and reciprocally within said chamber.

* * * * *